US006038789A

United States Patent [19]

Kaihovirta et al.

[11] Patent Number: 6,038,789

[45] Date of Patent: Mar. 21, 2000

[54] METHOD FOR CONTROLLING THE CURL OF PAPER AND A PAPER OR BOARD MACHINE LINE THAT APPLIES THE METHOD

[75] Inventors: Juha Kaihovirta; Pekka Pakarinen; Matti Luontama, all of Jyväskylä , Finland

[73] Assignee: Valmet Corporation, Helsinki, Finland

[21] Appl. No.: 09/079,821

[22] Filed: May 15, 1998

Related U.S. Application Data

[60] Provisional application No. 60/046,557, May 15, 1997.

[30] Foreign Application Priority Data

May 15, 1997 [FI] Finland ..... 972080

[51] Int. Cl.[7] ..... F26B 11/02; D21F 5/00

[52] U.S. Cl. ..... 34/448; 34/454; 34/117; 34/118; 34/120

[58] Field of Search ..... 34/444, 448, 454, 34/117, 118, 120; 162/206, 207, 358.3, 359.1; 427/209, 210, 211, 361

[56] References Cited

U.S. PATENT DOCUMENTS

| | | | |
|---|---|---|---|
| 3,948,721 | 4/1976 | Winheim | 162/207 |
| 4,207,143 | 6/1980 | Glomb et al. | 162/207 |
| 4,441,263 | 4/1984 | Vedenpää | 34/115 |
| 4,516,330 | 5/1985 | Eskelinen et al. | 34/23 |
| 4,549,932 | 10/1985 | Goetz et al. | 162/207 |
| 4,905,380 | 3/1990 | Eskelinen et al. | 34/23 |
| 5,020,469 | 6/1991 | Boissevain et al. | 118/67 |
| 5,022,163 | 6/1991 | Ilvespää et al. | 34/23 |
| 5,172,491 | 12/1992 | Ilvespää et al. | 34/115 |
| 5,416,980 | 5/1995 | Ilvespää | 34/117 |
| 5,465,606 | 11/1995 | Kerttula | 34/452 |
| 5,553,393 | 9/1996 | Korhonen et al. | 34/117 |
| 5,557,860 | 9/1996 | Kotitschke et al. | 34/455 |
| 5,756,156 | 5/1998 | Elijoki et al. | 427/316 |

FOREIGN PATENT DOCUMENTS

| | | | |
|---|---|---|---|
| 821431 | 10/1982 | Finland | B65H 23/34 |
| 94068 | 7/1990 | Finland | D21G 7/00 |
| 89952 | 9/1992 | Finland | D21F 7/00 |
| 98387 | 2/1995 | Finland . | |
| 963734 | 9/1996 | Finland . | |
| 964830 | 12/1996 | Finland . | |

*Primary Examiner*—Stephen Gravini
*Attorney, Agent, or Firm*—Steinberg & Raskin, P.C.

[57] ABSTRACT

A method for controlling the curl of paper in which steam treatment and/or moistening of the paper web is/are carried out after the calendering process being performed in the calender. In processes in which calendering is not employed, the curl is controlled in connection with a machine reel-up or in process steps carried out after the machine reel-up. A paper or board machine applying the method includes a headbox, a former, a press, a dryer section and steam boxes, moistening devices, an IR dryer and/or equivalent curl control devices. The steam boxes, moistening devices, IR dryers and/or equivalent curl control devices for the control of the curl are arranged after the calender or, if no calender is employed, in connection with a machine reel-up or a finishing process carried out after the machine reel-up.

42 Claims, 7 Drawing Sheets

METHOD FOR CONTROLLING THE CURL OF PAPER AND A PAPER OR BOARD MACHINE LINE THAT APPLIES THE METHOD

The following application claims priority under 35 USC 119 for provisional application 60/046,557 filed May 15, 1997.

FIELD OF THE INVENTION

The present invention relates to a method for controlling curl of paper in which steam treatment, moistening of the paper web and/or equivalent operations are employed in order to control the curl of the paper web.

Also, the present invention relates to a paper or board machine including a headbox, a former, a press, a dryer section and steam boxes, moistening devices, means for applying a one-sided drying impulse to the web and/or equivalent devices for controlling curl of the paper web.

BACKGROUND OF THE INVENTION

In the prior art, in multi-cylinder dryers of paper machines, twin-wire draw and/or single-wire draw is/are employed. When employing twin-wire draw, a group of drying cylinders comprises two closed (endless) wires, fabrics or belts which press the web, one from above and the other one from below, against heated cylinder faces of drying cylinders arranged in rows. Between the rows of drying cylinders, which are usually horizontal rows, the web has free and unsupported draws which are susceptible to fluttering and may cause web breaks, in particular when the web is still relatively moist and, therefore has a low strength. For this reason, in recent years, ever increasing use has been made of the single-wire draw in which each group of drying cylinders includes only a single closed (endless) drying wire on whose support the web runs through the entire group so that the drying wire presses the web on the drying cylinders against the heated cylinder faces thereof, whereas on the reversing cylinders or rolls arranged between the drying cylinders, the web remains at the side of the outside curve and is subjected to negative pressure as it runs over the reversing cylinders or rolls in order to maintain the web on the wire. Thus, in single-wire draw, the drying cylinders are arranged outside the wire loop, and the reversing cylinders or rolls are arranged inside the wire loop.

In so-called normal groups with single-wire draw, known in the prior art, the heated drying cylinders are placed in an upper row and the reversing cylinders or rolls are placed in a lower row below the upper row of drying cylinders, which rows are typically horizontal and parallel to one another. In the following, when the term "normal (dryer) group" is used, what is meant is expressly groups with single-wire draw in multi-cylinder dryers of the type mentioned above.

It is known to those skilled in the art that if paper is dried one-sidedly or unequalsidedly, the result is a tendency of curling of the sheet. For example, when paper is dried by means of normal groups with single-wire draw from the side of its bottom face only, the drying is asymmetric and if such asymmetric drying is extended over the entire length of the forward dryer section, the drying takes place so that first the bottom-face side of the paper web is dried and, when the drying makes progress, the drying effect is also extended to the side of the top face of the paper web. Under these circumstances, the dried paper is usually curled and becomes concave, when viewed from above.

As known in the prior art, the tendency of curling of paper (or the tendency to curl) is already affected in connection with the web formation, in particular at the sheet formation stage by means of the selection of the difference in speed between the slice jet and the wire, by means of the selection of the former and its mode of running and by means of other running parameters. For example, in the case of copying paper, by means of unequalsidedness of drying in the afterdryer, a suitable initial curl form is regulated for the sheet in order that the curling of the paper after one-sided or double-sided copying could be optimized. In the case of copying paper, the reactivity of curling, i.e., the extent to which curling occurs per unit of change in moisture content, is affected to a greater extent by means of a multi-layer structure of the paper, which is produced in connection with the web formation in the wet end.

With respect to the prior art related to the present invention, reference is made to the current assignee's Finnish Patent No. 91,900 (corresponding to U.S. Pat. No. 5,416,980 incorporated by reference herein), in which a method is described in the dryer section of a paper machine in particular for reducing the tendency of curling of paper. In this method, the paper web is dried by means of drying cylinders against whose heated faces the paper web is pressed by a drying wire. In the dryer section, groups of drying cylinders are used in which twin-wire draw and/or single-wire draw is/are applied. In this method, it has been considered advantageous that in the dryer section, substantially across the entire width of the paper web, hot water or steam is fed to relax strains or tensions that arise or tend to arise in the fiber mesh in the paper web in, or substantially directly after, the area of formation of the strains or tensions.

In the current assignee's Finnish Patent Application No. 963734 (corresponding to U.S. provisional patent application Ser. No. 60/030,693), a method is described for drying a surface-treated paper web or equivalent in an after-dryer of a paper machine as well as a dryer section of a paper machine for applying the method. With a view toward compensating for a tendency of curling of the paper web, in the after-dryer, the paper web is dried in a dryer group/groups making use of a normal single-wire draw. In connection with or after the drying, the paper web is treated by means of at least one device in order to compensate for a tendency of curling of the paper web, which devices are, for example, a steam box, a blower unit, a moistening device, and/or a soft calender.

On the other hand, in the current assignee's Finnish Laid-open Publication No. 98,387 (corresponding to U.S. patent application Ser. No. 08/705,059), a method is described for manufacturing a paper to be surface-treated, in particular fine paper, as well as a dry end of a paper machine for applying the method. The paper web, which has been dewatered by pressing, is dried in a forward dryer section in which drying energy is applied to the paper web over the entire length of the forward dryer section asymmetrically in the z-direction from the side of the bottom face of the web. This stage is carried out by means of a number of successive groups with single-wire draw that are open towards the bottom while the web is carried on support of a drying wire. In this manner, shrinkage of the web both in the machine direction and in the cross direction is substantially prevented, which shrinkage tends to occur with an increase in the dry solids content. In connection with a web break, the paper broke is removed from below the dryer groups that are open towards the bottom onto a broke conveyor placed underneath substantially by the effect of gravity. The paper web, which has a tendency of curling because of the asymmetric forward drying, then is passed into an after-dryer in which it is after-treated while, at the same time, moistened and/or plastically worked, so that the tendencies of curl that arose in it in the forward drying stage are eliminated. For example, the after-dryer may include groups with twin-wire draw and regulation of steam as well as steam boxes that have been arranged in view of controlling the curl, as well as infra and airborne web dryers.

In the current assignee's Finnish Patent Application 964830 (corresponding to U.S. Provisional Patent Application Ser. No. 60/032,405), a method is described for drying paper as well as a dry end of a paper machine. The method for drying of paper comprises the following steps:

the paper web to be dried is passed from the press section into a forward dryer section, in which the paper web is dried from the side of its bottom face in dryer groups that apply a normal single-wire draw, the forward dryer section comprises exclusively single-wire groups with normal single-wire draw, the paper web is passed from the forward dryer section into a finishing section in which the paper web is coated/surface-sized by means of coating/surface-sizing equipment, the paper web is passed from the finishing section to be dried in an after-dryer section in which the paper web is dried in at least one dryer group that applies normal single-wire draw, after the after-dryer section, the paper web is calendered in a calender and passed to a reeling station in which the paper web is reeled into a machine reel, and curling of the paper web is controlled by means of curl control elements and/or by means of assemblies and combinations formed out of such elements in the area of the forward dryer section and/or the finishing section.

The dry end of a paper machine described in FI 964830 comprises a forward dryer section, a finishing section which comprises a coating/surface-sizing apparatus, an after-dryer, a calender and a reeling station. The dry end of the paper machine comprises curl control elements and/or assemblies and combinations formed out of such curl control elements in view of controlling the curling of the paper web in the area of the forward dryer section and/or the finishing section. The elements for controlling the curling comprise, among other things, means for blowing hot moist air through the wire in the forward dryer section, steam boxes employed in the after-dryer, a combination in which steam-treatment by means of a steam box is combined with a cooling cylinder, a lower support belt or support wire in the after-dryer, twin-wire groups employed in the after-dryer, means for through-drying through the wire in connection with at least one cylinder in the after-dryer, a pre-selected ratio of cylinder diameters, means for spraying water against the web in the after-dryer, infrared boxes arranged before the calender, means for transferring moist air from the forward dryer to the after-dryer to be blown against the web, and mechanical working of the web by means of a spreader bar.

With respect to the prior art, reference is also made to U.S. Pat. No. 5,557,860, in which a dryer section is described which includes dryer groups that make use of a normal single-wire draw and a moistening device arranged after the dryer groups by whose means the curl is controlled.

From the prior art, it is also known to moisten the air that surrounds a winding device, in which case drying and shrinkage of the paper in the winding device are prevented. An excessively low relative humidity of the air surrounding the winding device results in uncontrolled drying and shrinkage of the paper, which again causes cutting off of the paper at the knife blades and makes the slitting more difficult and also makes the formation of splices more difficult. Under excessively dry conditions, there may also be difficulties in meeting the requirements of dimensional precision imposed on a roll. This prior art moistening system comprises moistening nozzles and air devices installed below the winding device. By means of these devices, the air that rises to the winding device is moistened and directed at the knife blades under controlled conditions. If necessary, the moisture level can be adjusted continuously. Thus, in this prior art construction, control of the curl of paper is not aimed at.

In the prior art constructions described above, the devices for the regulation of curl and the other, corresponding arrangements are placed in the dry end of the paper machine before the calender. It has been assumed that, if curl regulation operations are carried out after the calender, they have a detrimental effect on the surface properties of the paper. However, it is a drawback of a curl regulation device, such as a steam box or a moistening device, placed before the calender that, at the same time, the calendering result is affected to a great extent by the operation of the curl regulation device, i.e., the smoothness of the faces and the bulk of the paper is altered. This quite often prevents full control of the curl. On the other hand, the efficiency of a moistening/steam-treatment device suffers from the high temperature of the web. Devices arranged in the interior of the hood of the dryer section must also be designed in consideration of the hot and moist environment. Also possible servicing work must be carried out at times of standstills.

The curl regulation devices arranged before the calender must be placed near the end of the dryer section, at which time the temperature of the web and of the surrounding air is highest. In such a case, for example, the use of a steam box is not so efficient (without cooling of the web), for steam does not condense into the hot web (having a temperature of 70° C. to 80° C.) and thus, does not equalize the 2-way moisture profile. In order to cool the web, for example cooling cylinders are employed and as a result, the length of the dryer section is increased, which is not economically advisable. Also, at the end of the dryer section, owing to the hot web, larger quantities of steam or water are needed for correcting the 2-way moisture profile.

OBJECTS AND SUMMARY OF THE INVENTION

Accordingly, it is an object of the present invention to approach the problems related to the control of curl from a new point of view and to suggest novel solutions for such problems contrary to conventional modes of thinking.

Another object of the present invention is to provide methods for controlling curl of a web and a paper or board machine in which the operations necessary for controlling and regulating the curl can be carried out after the calender.

In view of achieving the objects stated above and those that will come out later, in the method in accordance with the invention, the operations for controlling the curl of the paper web are carried out after the calendering process carried out in the calender.

In a paper or board machine in accordance with the invention, steam boxes, moistening devices and/or equivalent curl control devices for controlling curl of the paper web are placed after the calender.

According to the invention, the curl is regulated after the calendering process by means of a steam box or a moistening device or by means of any other, equivalent curl control arrangement in itself known, for example, in connection with a winder, slitter-winder, intermediate calender, Pope-type reel-up, etc. The operations necessary for controlling the curl can be carried out, for example, as steam blowing carried out in connection with a reel-up, by means of steam boxes placed before the reel-up, by means of a steam box arranged in connection with the reel that is being formed, by means of a combination of moistening and steam treatment before the reel-up, by moistening the web before the reel-up, and/or by fitting, for example, an infra heater or an equivalent device by whose means the web is dried from the opposite side. Also, the curl control operations may be carried out in connection with an unwind stand, in which case, it is possible to turn the reel around, in which connection the curl regulation effect can be applied to the opposite face of the paper web.

By means of these novel arrangements, it is possible to act upon the curl of the paper web and to regulate the curl as desired. Since the curl control operations are not carried out until after the calender, an advantage is obtained that the control of the curl takes place as close to the final product as possible, and thereby the effects of all of the preceding process factors can be taken into account effectively. The temperature of the web is also rather low, in which case the effect of the steam treatment is high. Also, the devices can be placed so that they can also be serviced, at least partly, while the machine is in operation. Nor does a regulation of curl carried out after the calender, for example one-sided steam treatment, affect the calendering process and, thus, produce differences in the final product between the top face and the bottom face, for example roughness and glaze.

The operations that are carried out in accordance with the invention in order to control the curl are applied to one side or to both sides of the web.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
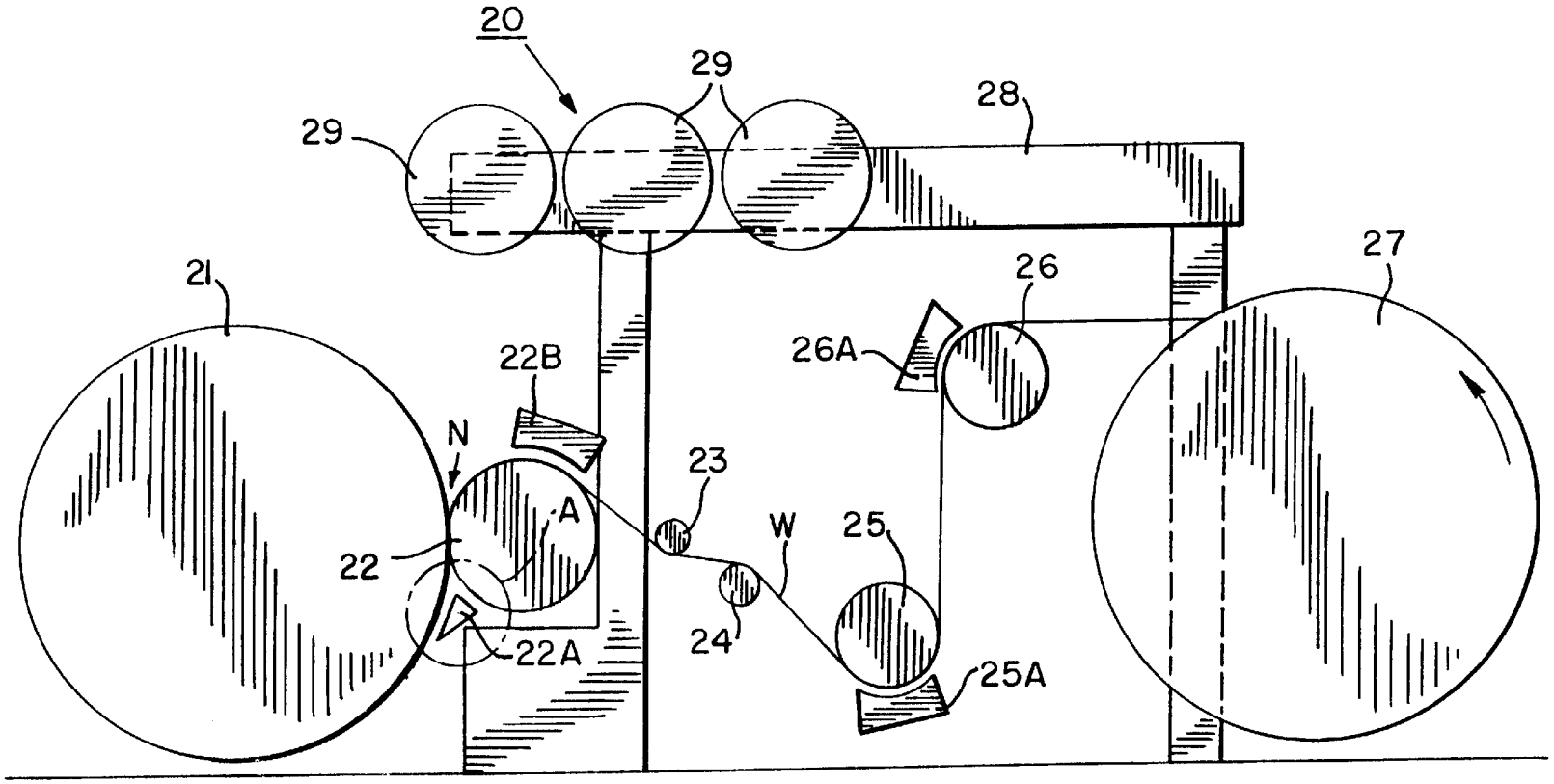
FIG. 1 is a schematic illustration of an exemplifying embodiment of the invention for controlling curl in connection with a reel-up.
Figure 1A:
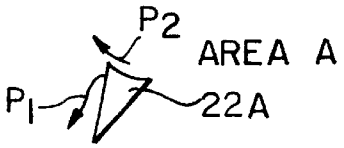
FIG. 1A is an enlarged view of area A in FIG. 1.

Referring to FIGS. 1–10 wherein like reference numerals refer to the same or similar elements, in the exemplifying embodiment of the invention that is illustrated schematically in FIG. 1, with a view toward controlling curl of a web W, after the calender, in connection with an online or off-line reel-up, the web W is unwound from a reel 27 over reeling drum 22 and alignment/guide rolls 23, 24, 25, 26 into reel 21. The frame constructions of the reel-up are denoted generally by reference numeral 28, and the empty reel spools placed in the spool store are denoted by reference numeral 29. FIG. 1 shows possible different alternatives for placing the curl control device in connection with the reel-up 20. For example, below a reeling nip N defined between the reel 21 and the reeling drum 22, it is possible to place a steam blow box 22A or an equivalent steam or moisture application device, of which a partial enlarged illustration is shown in FIG. 1A. From the steam blow box 22A or equivalent source, steam blowings are applied either into the nip N, represented by blowing $P_2$, or toward a face of the reel 21, represented by blowing $P_1$. In accordance with further alternatives, a steam blow box or an equivalent steam and/or moisture application device 25A, 26A is arranged in connection with, i.e., operative against or in opposed relationship to, the respective alignment/guide roll 25,26 and a steam blow box or an equivalent steam and/or moisture application device 22B is arranged in connection with the reeling drum 22.

Figure 2:
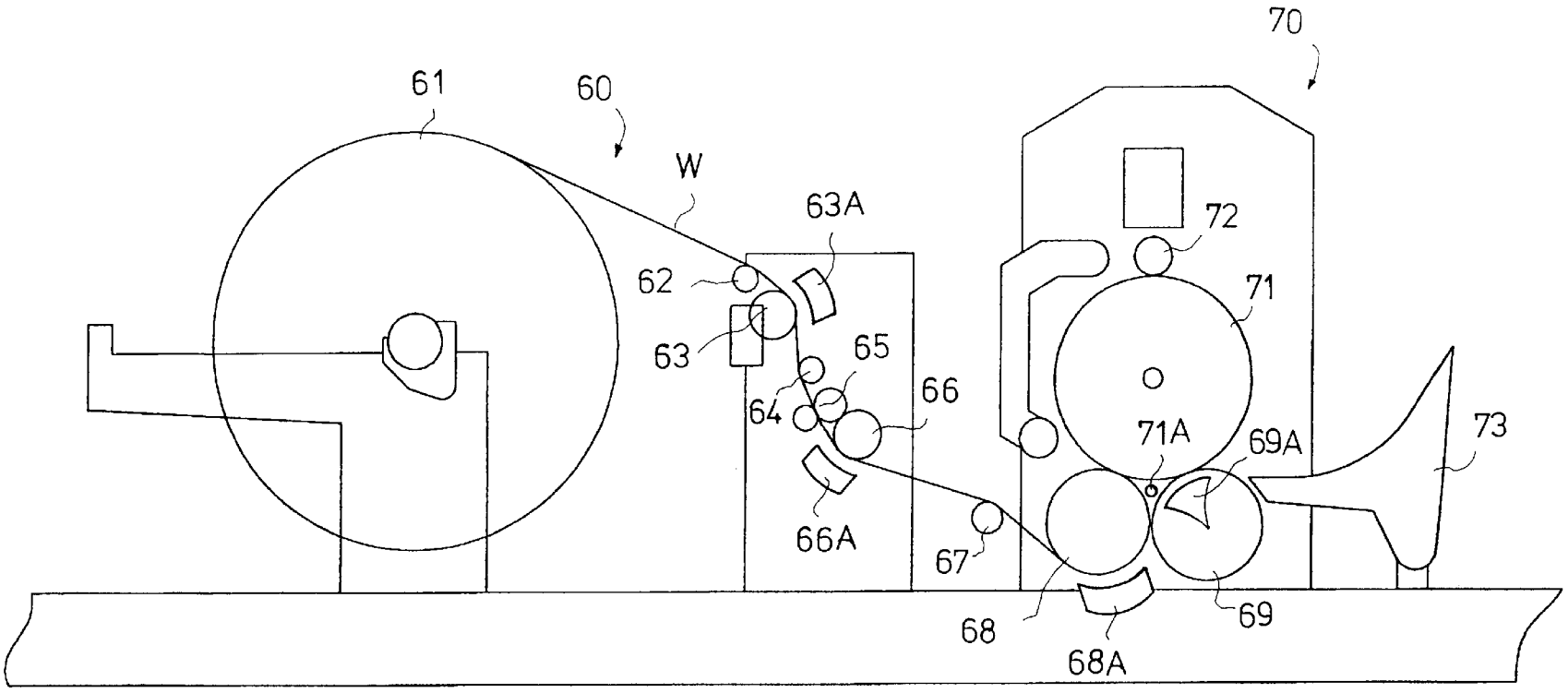
FIG. 2 is a schematic illustration of an exemplifying embodiment of the invention for controlling curl in connection with an unwind stand.

In the exemplifying embodiment of the invention illustrated schematically in FIG. 2, the paper web W is unwound in an unwind station 60 from a reel 61, and the web W is passed over alignment/guide rolls 62,63,64 to a slitter 65, from which it is further passed over alignment/guide rolls 66,67 to a drum winder 70. In the drum winder 70, the web W is wound into a paper roll 71 on support of winding drums 68 and 69, and in connection with the winding, a rider roll 72 is employed. Reference numeral 73 denotes a roll transfer device. With a view toward controlling curl of the web W, in connection with such an assembly of equipment, various devices are arranged to control the curl. For example, in connection with the alignment roll 63 and/or 66, it is possible to position steam blow boxes 63A,66A or equivalent steam and/or moisture application devices. In connection with the winder 70, and more particularly in connection with the winding drum 68, it is possible to arrange a steam box 68A. Further, the winding drum 69 may be a steam roll into which a steam blow zone or steam-treatment zone 69A is formed, or a steam pipe 71A may be placed in the space between the winding drums 68,69 and the paper roll 71 that is being formed. If necessary, in the unwind stage, the paper roll 61 can be turned around, in which connection the effect of the curl regulation can be applied to the opposite side of the paper web W.

In the embodiments shown in FIGS. 3–9, the last two groups $R_1$,$R_2$ with single-wire draw in the dry end 30 of the paper machine are seen. These dryer groups are constructed such that the web W has a closed draw in the gap therebetween. In the illustrations, the machine direction, i.e., the running direction of the web W is denoted by arrow S. The single-wire groups $R_1$,$R_2$ are so-called normal groups, in which steam-heated smooth-faced drying cylinders 10 are placed in an upper horizontal row and reversing suction cylinders 11 are placed in a lower horizontal row. Each dryer group $R_1$,$R_2$ has a drying wire 15 of its own, which is guided by guide rolls 18. The drying wires 15 press the web W to be dried against the smooth heated faces of the drying cylinders 10 and on the reversing cylinders 11 the web W remains at the side of the outside curve on the outer face of the wire 15. On the reversing cylinders 11, the web W is kept reliably on support of the wire 15 against the effect of centrifugal forces by the effect of a vacuum present in grooved faces of the reversing cylinders 11 or in a perforated mantle of an equivalent suction roll, by means of which effect cross-direction shrinkage of the web W is also counteracted. The reversing suction cylinders 11 that are used are particularly favorably suction cylinders marketed by the current assignee with the trade mark VacRoll™, which have no inside suction boxes and with respect to details of their construction, reference is made to the current assignee's Finnish Patent No. 83,680 (corresponding to U.S. Pat. Nos. 5,022,163 and 5,172,491). The support contact between the web W and the drying wire 15 is kept adequate also on the straight runs between the drying cylinders 10 and the reversing cylinders 11 by using blow-suction boxes 17 at least on the runs from the drying cylinders 10 to the reversing cylinders 11. By means of the blow-suction boxes 17, the formation of pressures induced by the wire 15 is also prevented in the closing wedge-shaped nip spaces defined between the wire 15 and the cylinder 11 mantles. The blow-suction boxes 17 are understood as blow boxes whose blowing of air produces a vacuum, and the boxes 17 do not communicate with sources of vacuum. With respect to details of their construction, the blow-suction boxes 17 may be those marketed by the current assignee with the trade mark "UnoRun BlowBox"™, and in this regard, reference is made to the current assignee's Finnish Patent Nos. 59,637, 65,460 and 80,491 (corresponding to U.S. Pat. Nos. 4,441, 263, 4,516,330 and 4,905,380, respectively). Blow box constructions of other types in themselves known are also included in the scope of the overall concept of the present invention. In the groups $R_1$,$R_2$ with single-wire draw, blow boxes 16 are also used in the gaps between the reversing cylinders 11. By means of the blow boxes 16, the intermediate spaces are air-conditioned and evaporation taking place from the web W is promoted. The faces of drying cylinders 10 are kept clean by doctors 14.

Further, in the embodiments of the invention shown in FIGS. 3–9, the finishing section includes a machine reel-up 50, such as a Pope-type reel-up. The machine reel that is being made by means of the reel-up 50 is denoted by reference MRo, and one complete machine reel is denoted by reference MR. The web W is brought to the machine reel-up 50 through a calender 40 from an after-dryer 30 over guide and alignment rolls 35,45,46,47. After the last guide/alignment roll 47, a measurement device 48 is arranged to measure the properties of the web W before reeling. The calender 40 may be favorably a so-called soft calender, in which one roll can be heated and the other roll has a soft coating. Of course, the calender may also consist of two hard rolls. There may also be several calender nips.

Figure 3:
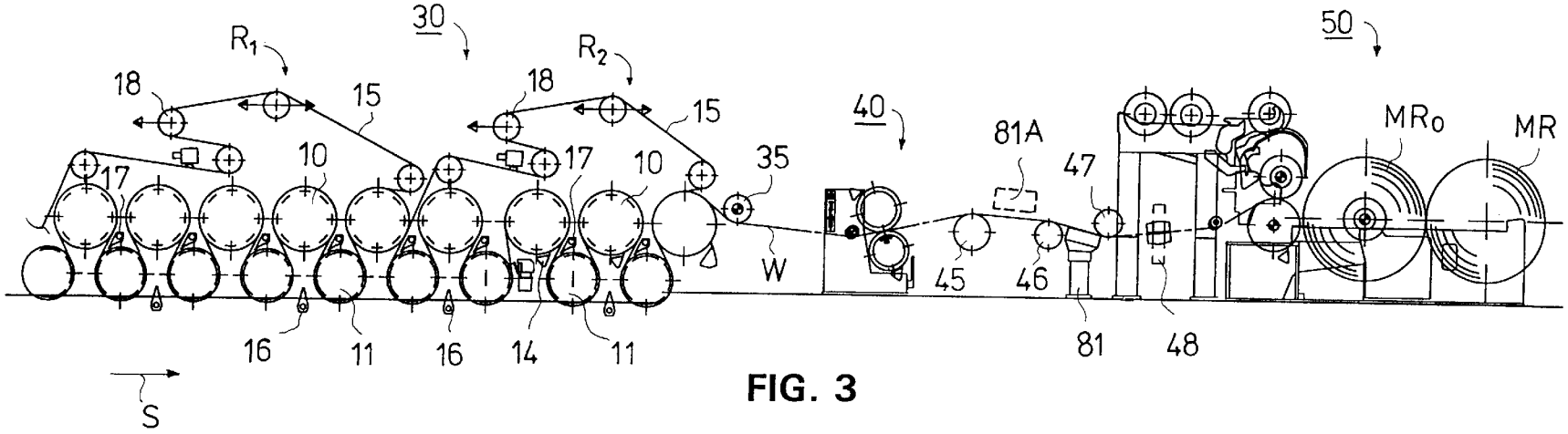
FIG. 3 is a schematic illustration of an exemplifying embodiment of the invention for controlling curl after the calendering process, in which embodiment, in view of controlling curl, a steam box is arranged before the reel-up.

In FIG. 3, in order to control the curl, a steam box 81 is positioned on the run of the web W between the guide/alignment rolls 46,47, in which case, the curl is affected after the calendering process and before the reel-up 50. If it is desired to control the tendency of curling efficiently in both directions, a steam box 81A or equivalent steam and/or moisture applicator device can also be arranged above the web.

Figure 4:
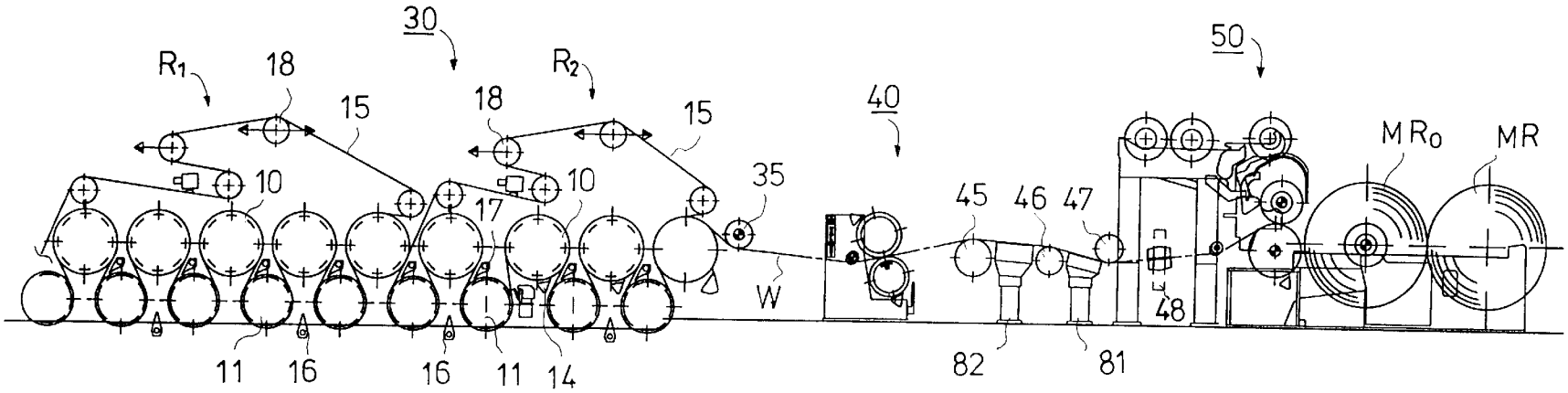
FIG. 4 is a schematic illustration of an exemplifying embodiment of the invention for controlling curl after the calendering process, in which embodiment, in view of controlling curl, two steam boxes are arranged before the reel-up.

In FIG. 4, a steam box 82 is arranged between the alignment/guide rolls 45 and 46, and the steam box 81 is arranged on the run of the web between the alignment/guide rolls 46,47, the control of the curl of the web being affected by means of both steam boxes on the run of the web W between the calender 40 and the reel-up 50.

Figure 5:
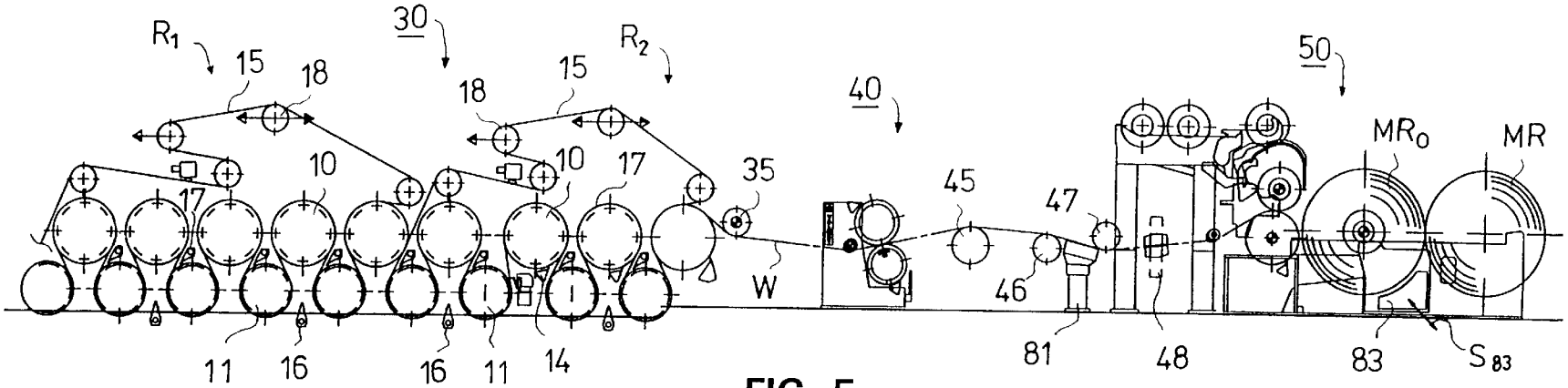
FIG. 5 is a schematic illustration of an exemplifying embodiment of the invention, in which, in view of controlling curl, a steam box is arranged before the reel-up and in connection with the paper reel that is being formed in the reel-up.

In FIG. 5, in addition to the steam box 81 arranged on the run between the alignment/guide rolls 46,47, a steam box 83 is arranged in connection with the paper reel MRo that is being formed, in which case, besides in connection with the run of the web between the calender 40 and the reel-up 50, the control of the curl is also affected in connection with the making of the reel MRo that is being formed. Thus, in connection with the reel MRo that is being formed, steam box 83 is arranged and which can be displaceable, which is illustrated by the arrow $S_{83}$. The steam box 83 is shifted as the reel size becomes larger when the reeling proceeds.

Figure 6:
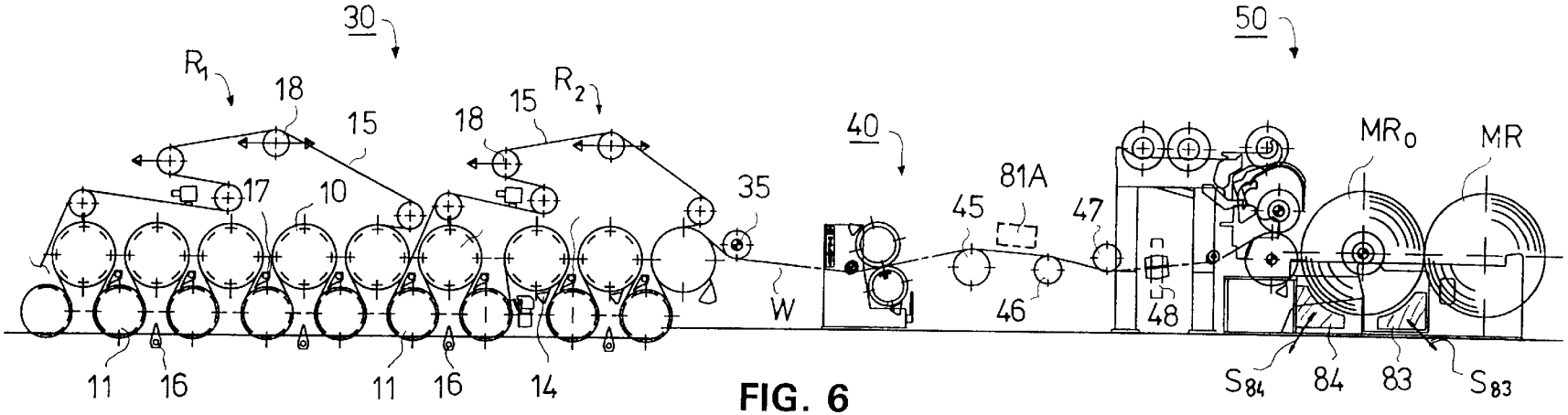
FIG. 6 is a schematic illustration of an exemplifying embodiment of the invention, in which, in view of controlling curl, two steam boxes are arranged in connection with the paper reel that is being formed in the reel-up.

In FIG. 6, in connection with the reel MRo that is being formed, two steam boxes 83,84 are arranged, both of which are displaceable (the displaceability being illustrated by arrows $S_{83}$,$S_{84}$) as the reel size is increased with the progress of the reeling. In order to provide regulation of curl from the top side, of course, also in this connection, it is possible to use a steam or moistening device 81 A arranged above the web.

Figure 7:
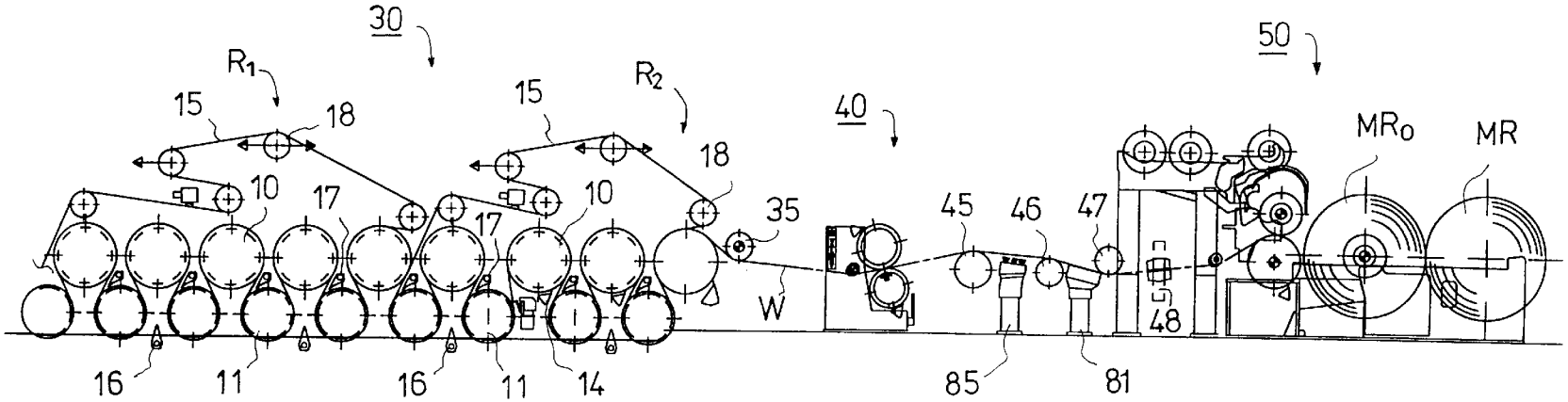
FIG. 7 is a schematic illustration of an exemplifying embodiment of the invention for controlling curl after the calendering process, in which embodiment, in view of controlling curl, both a moistening device and a steam device are arranged before the reel-up.

In FIG. 7, besides the steam box 81 arranged on the run of the web W between the alignment/guide rolls 46,47, a web W moistening device 85 is arranged on the run of the web W between the alignment/guide rolls 45,46. In this case, the curl of the web W is controlled after the calender 40 and before the reel-up 50 both by means of a moistening treatment and by means of a steam treatment.

Figure 8:
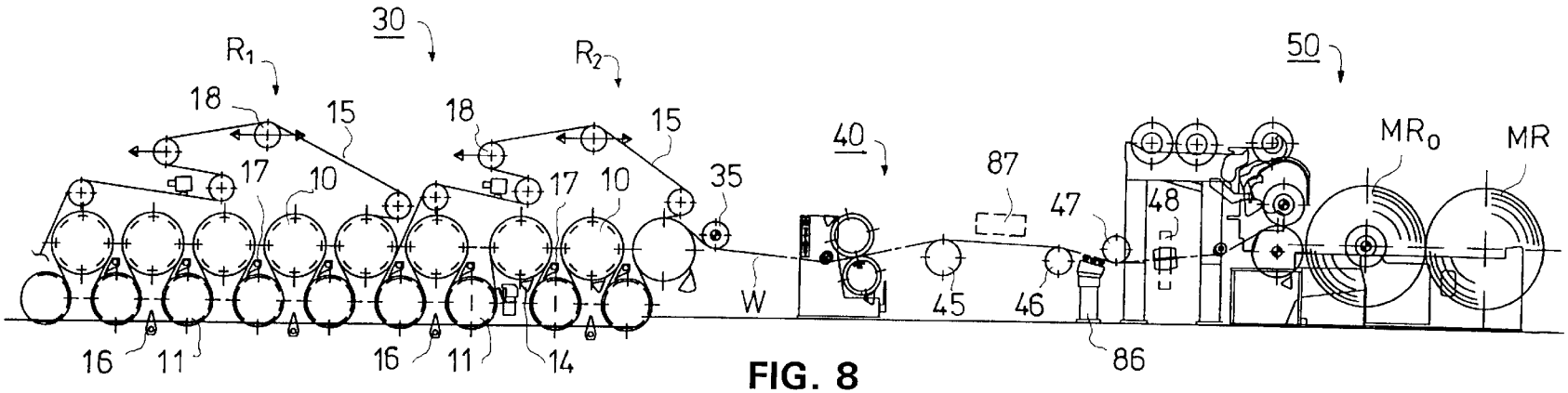
FIG. 8 is a schematic illustration of an exemplifying embodiment of the invention in which, in view of controlling curl, a moistening device is arranged before the reel-up.

In FIG. 8, with a view toward controlling the curl after the calender 40, a moistening device 86 is arranged on the run of the web W between the alignment/guide rolls 46,47. FIG. 8 also shows an IR dryer 87 by whose means an impulse of thermal energy can be applied to the top face of the web so as to affect the tendency of curling of the ultimate paper product. Instead of IR drying, it is also possible to use some other dryer device. Likewise, such drying devices can be placed at both sides of the web to be operative against both sides of the web. Regulation of curl by means of one-sided additional drying can be employed either alone or in combination with steam-treatment and/or moistening devices.

Figure 9:
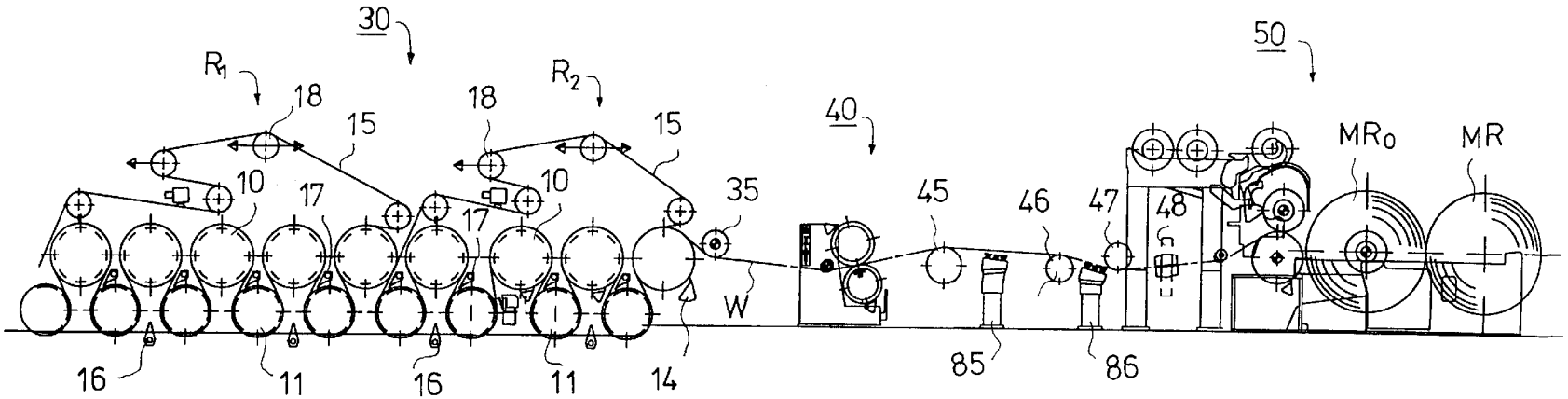
FIG. 9 is a schematic illustration of an exemplifying embodiment of the invention in which, in view of controlling curl, two moistening devices are arranged before the reel-up.

In the exemplifying embodiment shown in FIG. 9, moistening devices 85,86 are arranged on the runs of the web W between the alignment/guide rolls 45,46 and 46,47 so as to control the curl of the web W after completion of calendering before the reel-up 50. Of course, it is also possible to employ one moistening device only, or the moistening devices can be placed at opposite sides of the web.

Figure 10:
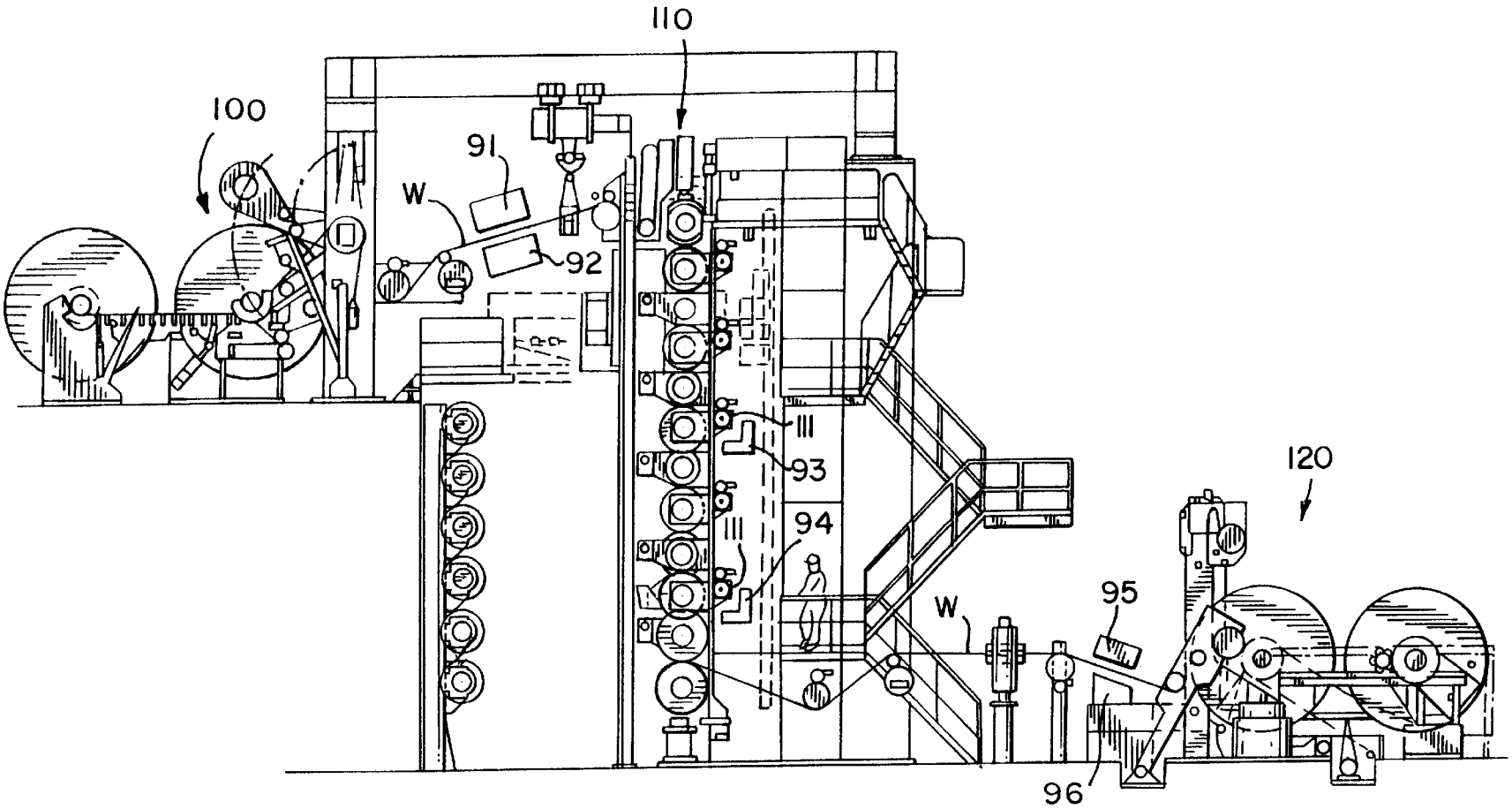
FIG. 10 is a schematic illustration of an exemplifying embodiment of the invention in which the curl control devices are arranged in connection with a supercalender.

In the exemplifying embodiment shown in FIG. 10, the regulation of curl is carried out in connection with a supercalender 110. The web W runs from an unwind stand 100 to the top portion of the supercalender 110 and from the bottom portion of the supercalender 110 further to a reel-up 120. The supercalender 110 consists of a vertical stack of rolls, in which the web W glazing nips consist of a hard-faced and a soft-faced roll. In the figure, a few possible positions (91, 92,93,94,95,96) are indicated in which it is possible to employ steam boxes and/or moistening devices and/or devices that heat the web face intensively. Thus, the devices can be placed on the run (91,92) of the web W between the unwind stand 100 and the supercalender 110 and/or in connection with the take-out leading rolls 111 in the supercalender 110 (93,94) and/or on the run of the web W between the supercalender 110 and the reel-up 120 (95,96).

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims. For example, the features suggested in the different exemplifying embodiments of the invention may be combined in a number of different ways for the purpose of controlling the curl of the web. Of course, in accordance with the invention, after the calendering process, it is also possible to use other arrangements in themselves known to a person skilled in the art in order to control the curl.

We claim:

1. A method for controlling curl of a paper web dried by passing through a dryer section, comprising the steps of:

at least one of subjecting the web to a last calendering step prior to reeling after the web has passed through the dryer section and reeling the web to form a reel after the web has passed through the dryer section, and affecting the web in order to adjust the curl of the web after the web has been subjected to the last calendering step or reeled.

2. The method of claim 1, wherein the web is calendered.

3. The method of claim 2, wherein the step of affecting the web comprises the step of applying steam to the web or moistening the web.

4. The method of claim 3, wherein the web is also reeled after it is calendered, the step of applying steam to the web or moistening the web comprising the step of arranging a steam box or moistening device at a location after the web is calendered and before the web is reeled.

5. The method of claim 3, wherein the web is also reeled after it is calendered, the step of applying steam to the web or moistening the web comprising the step of arranging a steam box and a moistening device at a location after the web is calendered and before the web is reeled.

6. The method of claim 3, wherein the web is also reeled after it is calendered, the step of applying steam to the web or moistening the web comprising the step of arranging a moistening device at a location after the web is calendered and before the web is reeled to moisten the web.

7. The method of claim 1, wherein the web is reeled.

8. The method of claim 7, wherein the step of affecting the web comprises the step of applying steam to the web or moistening the web.

9. The method of claim 8, wherein the step of applying steam to the web or moistening the web comprises the step of arranging at least one steam box or moistening device in opposed relationship to the reel such that steam is applied to the web or the web is moistened during reeling of the web.

10. The method of claim 9, further comprising the step of:

displacing each of the at least one steam box or moistening device as the reel increases in size.

11. The method of claim 8, wherein the steam is applied to the web or the web is moistened after the web has been reeled.

12. The method of claim 11, further comprising the steps of:

unwinding the web from the reel, and passing the web over a reeling drum to form another reel, the step of applying steam to the web or moistening the web comprising the step of arranging at least one steam box or moistening device in opposed relationship to the reeling drum.

13. The method of claim 11, further comprising the steps of:

unwinding the web from the reel, and passing the web over alignment/guide rolls to be wound to form another reel, the step of applying steam to the web or moistening the web comprising the step of arranging at least one steam box or moistening device in opposed relationship to at least one of the alignment/guide rolls.

14. The method of claim 11, further comprising the steps of:

unwinding the web from the reel at an unwind stand, passing the web from the unwind stand over a first set of alignment/guide rolls to a slitter to be slit therein, and passing the slit webs from the slitter over a second set of alignment/guide rolls to be wound into other reels, the step of applying steam to the web or moistening the web comprising the step of arranging at least one steam box or moistening device in opposed relationship to at least one of the alignment/guide rolls of the first and second sets of alignment/guide rolls.

15. The method of claim 11, further comprising the steps of:

unwinding the web from the reel at an unwind stand, passing the web over alignment/guide rolls to another reel, and supporting the another reel on a pair of winding drums, the step of applying steam to the web or moistening the web comprising the step of arranging at least one steam box or moistening device in opposed relationship to one of the winding drums.

16. The method of claim 11, further comprising the steps of:

unwinding the web from the reel at an unwind stand, passing the web over alignment/guide rolls to another reel, and supporting the another reel on a pair of winding drums, the step of applying steam to the web or moistening the web comprising the step of forming a steam-treatment zone in one of the winding drums.

17. The method of claim 11, further comprising the steps of:

unwinding the web from the reel at an unwind stand, passing the web over alignment/guide rolls to another reel, and supporting the another reel on a pair of winding drums, the step of applying steam to the web or moistening the web comprising the step of passing steam through a steam pipe into a space defined between the another reel and the winding drums.

18. The method of claim 1, wherein the step of affecting the web comprises the step of applying a one-sided drying impulse to the web.

19. The method of claim 18, further comprising the step of:

producing the one-sided drying impulse by means of at least one IR dryer.

20. The method of claim 18, wherein the step of affecting the web further comprises the step of applying steam to the web or moistening the web.

21. In a paper or board machine including a headbox for discharging pulp, a former for forming a web from the pulp, a press for dewatering the web, and a dryer section for drying the web, the improvement comprising:

at least one of a last calender arranged after the dryer section for calendering the web and a machine reel-up arranged after the dryer section for reeling the web to form a reel, and curl control means arranged after said at least one of said last calender and said reel-up for controlling curl of the web.

22. The paper or board machine of claim 21, wherein the paper or board machine includes said calender, said curl control means comprising a steam box or a moistening device arranged after said calender.

23. The paper or board machine of claim 21, wherein the paper or board machine includes said reel-up, said curl control means comprising at least one steam box or moistening device arranged in opposed relationship to the reel and acting on the web as the web is being reeled.

24. The paper or board machine of claim 23, wherein each of said at least one steam box or moistening device is displaceable as the reel increases in size.

25. The paper or board machine of claim 21, wherein the paper or board machine includes said reel-up, further comprising a finishing device for performing a finishing process on the web after the web has been reeled in said reel-up, said curl control means comprising a steam box or a moistening device arranged in connection with the finishing device.

26. The paper or board machine of claim 21, wherein the paper or board machine includes said reel-up, said curl control means comprising a steam box or a moistening device arranged to act on the web after the web has been reeled.

27. The paper or board machine of claim 26, further comprising an unwind stand in which the reel is unwound, and a reeling drum arranged in nip-defining relationship with another reel, the unwound web being passed over said reeling drum to be wound onto the another reel, said steam box or moistening device being arranged in opposed relationship to said reeling drum.

28. The paper or board machine of claim 26, further comprising an unwind stand in which the reel is unwound, and alignment/guide rolls over which the unwound web is passed to be wound onto another reel, said steam box or moistening device being arranged in opposed relationship to one of said alignment/guide rolls.

29. The paper or board machine of claim 26, further comprising an unwind stand in which the reel is unwound, a slitter for slitting the web, and alignment/guide rolls arranged before and after said slitter for guiding the unwound web through said slitter, said steam box or moistening device being arranged in opposed relationship to one of said alignment/guide rolls.

30. The paper or board machine of claim 26, further comprising an unwind stand in which the reel is unwound, alignment/guide rolls for guiding the unwound web from the unwind stand to another reel, and a pair of winding drums for supporting the another reel, said steam box or moistening device being arranged in opposed relationship to one of said winding drums.

31. The paper or board machine of claim 21, wherein the paper or board machine includes said reel-up, further comprising an unwind stand in which the reel is unwound, alignment/guide rolls for guiding the unwound web from the unwind stand to another reel, and a pair of winding drums for supporting the another reel, said curl control means comprising a steam-treatment zone formed in one of said winding drums.

32. The paper or board machine of claim 21, wherein the paper or board machine includes said reel-up, further comprising an unwind stand in which the reel is unwound, alignment/guide rolls for guiding the unwound web from the unwind stand to another reel, and a pair of winding drums for supporting the another reel, said curl control means comprising a steam pipe for passing steam into a space defined between the another reel and said winding drums.

33. The paper or board machine of claim 21, wherein the paper or board machine includes both said calender and said reel-up, said reel-up being arranged after said calender, said curl control means comprising at least one steam box arranged between said calender and said reel-up.

34. The paper or board machine of claim 21, wherein the paper or board machine includes both said calender and said reel-up, said reel-up being arranged after said calender, said curl control means comprising a steam box and moistening device arranged between said calender and said reel-up.

35. The paper or board machine of claim 21, wherein the paper or board machine includes both said calender and said reel-up, said reel-up being arranged after said calender, said curl control means comprising at least one moistening device arranged between said calender and said reel-up.

36. The paper or board machine of claim 21, wherein the paper or board machine includes said calender, said calender being a soft calender.

37. The paper or board machine of claim 21, wherein the paper or board machine includes said calender, said calender consisting of hard-faced rolls.

38. The paper or board machine of claim 37, wherein said calender is a supercalender.

39. The paper or board machine of claim 21, wherein the paper or board machine includes said calender, said calender being a supercalender, said curl control means comprising at least one moistening/steam-treatment/heating device arranged to act on the web as the web is being calendered in said supercalender.

40. The paper or board machine of claim 21, wherein said curl control means are structured and arranged to profile the web in a cross direction of the machine.

41. A method for controlling curl of a paper web dried by passing through a dryer section, comprising the steps of:

subjecting the web to a last operational step affecting curl prior to reeling after the web has passed through dryer section, affecting the web in order to adjust the curl of the web after the web has been subjected to the last operational step affecting curl, and reeling the web to form a reel.

42. In a paper or board machine including a headbox for discharging pulp, a former for forming a web from the pulp, a press for dewatering the web, and a dryer section for drying the web, the improvement comprising:

a last calender arranged after the dryer section for calendering the web and a machine reel-up arranged after the dryer section for reeling the web to form a reel, and curl control means arranged after said last calender and said reel-up for controlling curl of the web.

* * * * *